US006974925B2

(12) United States Patent
Whitman

(10) Patent No.: US 6,974,925 B2
(45) Date of Patent: Dec. 13, 2005

(54) SABBATH SWITCH COVER FOR APPLIANCES

(76) Inventor: Jonathan Whitman, 3301 W. Strathmore Ave., Baltimore, MD (US) 21215

( * ) Notice: Subject to any disclaimer, the term of this patent is extended or adjusted under 35 U.S.C. 154(b) by 0 days.

(21) Appl. No.: 10/745,312

(22) Filed: Dec. 23, 2003

(65) Prior Publication Data

US 2005/0133353 A1 Jun. 23, 2005

(51) Int. Cl.[7] ..... H01H 13/04
(52) U.S. Cl. ..... 200/333; 200/43.16
(58) Field of Search ..... 200/333, 331, 200/43.16–43.22, 332, 337, 304, 338; 174/66, 174/67

(56) References Cited

U.S. PATENT DOCUMENTS 2,873,333 A * 2/1959 Jacaman ..... 200/296
4,726,063 A * 2/1988 Chahley et al. ..... 200/43.18
4,798,916 A * 1/1989 Engel et al. ..... 174/67
4,810,833 A * 3/1989 Meyers ..... 174/67
4,914,265 A * 4/1990 Mongeau ..... 200/330
4,968,856 A * 11/1990 Bowley et al. ..... 174/67
4,972,045 A * 11/1990 Primeau ..... 200/330
5,449,860 A * 9/1995 Buckshaw et al. ..... 174/67
5,934,919 A * 8/1999 Cross et al. ..... 439/136
5,998,747 A * 12/1999 Kelso et al. ..... 200/331
6,669,492 B1 * 12/2003 McIlvenna ..... 439/135

* cited by examiner

*Primary Examiner*—Marina Fishman
(74) *Attorney, Agent, or Firm*—Law Offices of Royal W. Craig

(57) ABSTRACT

A Sabbath Switch Cover that easily mounts with adhesive film inside any major kitchen appliance directly adjacent to the switch housing, and which incorporates a self-adhesive cover plate and a slide member that can be urged in or out of the cover plate, thereby selectively covering the recessed spring-detent of the appliance switch. The slide member stays in place over the spring switch until it is manually slid back into the switch cover plate, when normal light operations resume. The Sabbath Switch Cover can be used to selectively disable or enable the internal lighting system of most major kitchen appliances in order to assist in keeping the Jewish Sabbath and Holidays, and it is easily manufactured, inexpensive to produce and purchase, and convenient to apply and use.

7 Claims, 5 Drawing Sheets

SABBATH SWITCH COVER FOR APPLIANCES

BACKGROUND OF THE INVENTION

1. Field of the Invention

The present invention relates to devices for keeping the Jewish Sabbath and Holidays and, more particularly, to a switch cover for selectively disabling the internal lighting system of conventional kitchen appliances.

2. Description of the Background

"And on the seventh day God ended His work which He had done, and He rested on the seventh day from all His work which He had done. Then God blessed the seventh day and sanctified it, because in it He rested from all His work which God had created and made" (Genesis 2:2–3). As interpreted and implemented under Jewish law, the purpose of the Jewish Sabbath and Holidays is to rest from physical labor and to worship God. The Jewish Talmud categorically specifies categories of work prohibited on the Jewish Sabbath and Holidays. For example, according to Jewish law one may not open or close an electrical circuit on the Jewish Sabbath and Holidays. Thus, Jews observing the Jewish Sabbath and Holidays may not turn on or off any electrical appliances.

Unfortunately, technology often makes it difficult to comply. For example, many kitchen ovens now have a safety shut-off feature that automatically shuts off the appliance after a period of use. This is sensible and safe, but it is problematic for Jews who require the oven to remain on over the Jewish Sabbath and Holidays. The religious stricture not to work for 24 hours on the Jewish Sabbath, and longer on some Holidays, led a few manufacturers to correct the situation with ovens that incorporate a "Sabbath-mode." The Sabbath-mode keeps an oven on at a specified temperature for as long as it is required, essentially overriding the auto-shut-off. This innovation first appeared in KitchenAid ovens back in 1994, overriding the normal 12-hour safety shut-off. On these KitchenAid ovens the observant cook can press keypad number six for five seconds offering a choice of baking at 170 to 500 degrees Fahrenheit for an unlimited time. *The Weekly Home Furnishings Newspaper*, Dec. 19, 1994.

However, in practice, this is not a foolproof solution, because the Sabbath-mode for ovens is mostly geared for Holidays that last more than one day, i.e. Passover, when it becomes necessary to cook or heat food after the initial 12 hour period. Since Sabbath food must already be cooked before Sundown, most people prefer to use the standard oven timer to keep the food warm for a few hours on Friday night rather than engage the Sabbath-mode which would leave the oven on unnecessarily for 24 hours, wasting electric or gas. Nonetheless, even when the issue is resolved for oven heating, the issue of the oven light still remains. When the oven door is opened the light turns on, and there is no existing way to disable this.

Indeed, the same issue arises and poses a practical problem when opening the door of any refrigerator, freezer, or oven. Nearly all such major kitchen appliances have an internal lighting system controlled by a mechanical switch located on the inside panel. This spring-loaded switch activates when the door opens, thereby causing the switch to open the electrical circuit connected to the light. When the door closes, it forces the switch to close the electrical contact, causing the light to turn off. Traditionally, this problem has been addressed either by taping down the switch each week before the Jewish Sabbath and Holidays, or by unscrewing the appliance's light bulb. Neither of these solutions is convenient.

Accordingly, there is a significant demand for a retrofit-type device that selectively enables/disables the internal lighting system switch located on the inside panel of most refrigerators, freezers and ovens, to make it easier for Orthodox Jews to keep the Jewish Sabbath and Holidays.

SUMMARY OF THE INVENTION

It is, therefore, an object of the present invention to provide a simple device for disabling the internal lighting system of major kitchen appliances in order to assist in keeping the Jewish Sabbath and Holidays.

It is another object to provide a retrofit-type switch cover for selectively disabling the internal lighting system of conventional kitchen appliances such as refrigerators, freezers, ovens and the like.

It is still another object to provide a Sabbath Switch Cover as described above that is easily manufactured, inexpensive to produce and purchase, and convenient to use.

These and other objects are accomplished by the present invention, which is a Sabbath Switch Cover that easily mounts with adhesive film inside any major kitchen appliance directly adjacent to the switch housing, and which incorporates a slide member that can be urged in or out of the Sabbath Switch Cover, thereby selectively covering the recessed spring-detent of the appliance switch. The slide member stays in place over the spring switch until it is manually slid back into the Sabbath Switch Cover when normal light operations resume.

BRIEF DESCRIPTION OF THE DRAWINGS

Other objects, features, and advantages of the present invention will become more apparent from the following detailed description of the preferred embodiment and certain modifications thereof when taken together with the accompanying drawings in which.

DETAILED DESCRIPTION OF THE PREFERRED EMBODIMENTS

Figure 1:
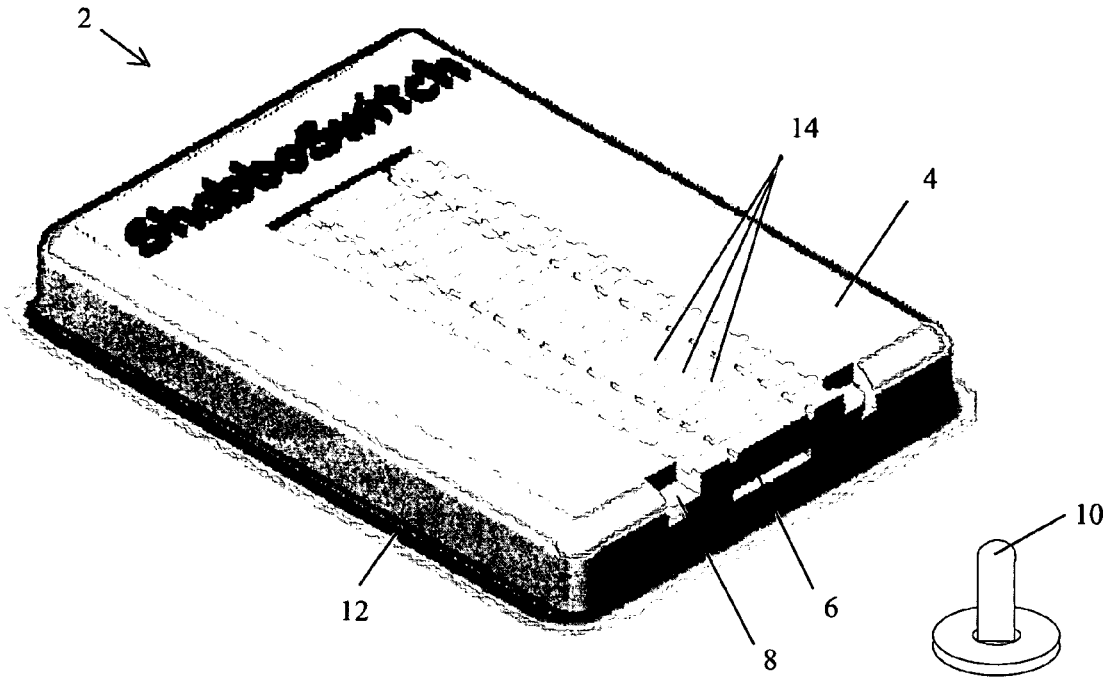
FIG. 1 is a perspective view of the Sabbath Switch Cover 2 according to a preferred embodiment of the present invention in retracted position for normal light operation.
Figure 2:
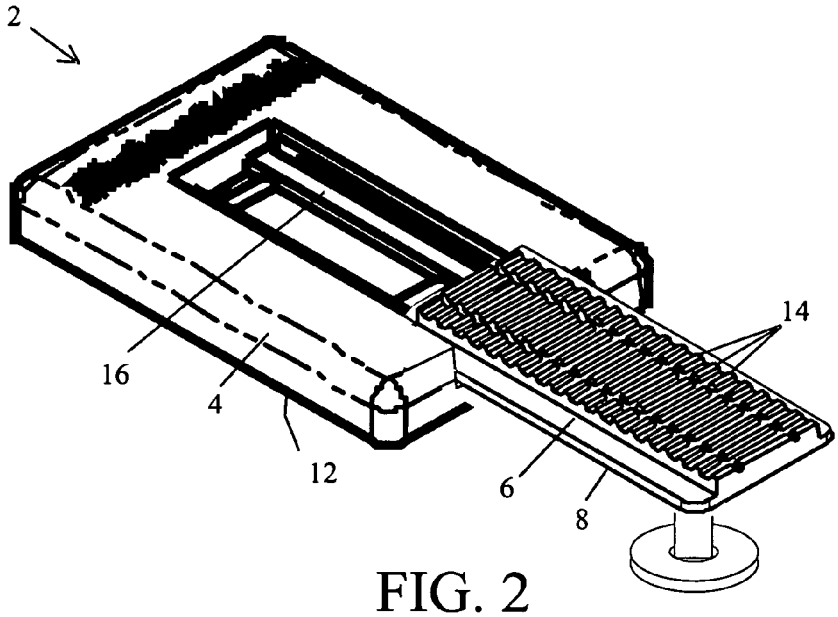
FIG. 2 is a perspective view of the Sabbath Switch Cover 2 as in FIG. 1 in extended position for Sabbath-mode light operation in which the appliance light operation is disabled.

Referring to FIGS. 1 and 2, the present invention is a Sabbath Switch Cover 2 that easily mounts with self-adhesive film 12 inside any major kitchen appliance directly adjacent to the existing spring-detent switch 10, and which incorporates a slide member 6 that can be urged in or out of a cover plate 4, thereby selectively covering the recessed spring switch 10 of the appliance. The slide member 6 stays in place over the spring switch 10 until it is manually slid back into the cover plate 4, wherein normal light operations resume.

As seen in FIG. 2, slide member 6 is a substantially rectangular section preferably formed with raised ribs 14 along its top surface to improve finger-grip. Slide member 6 is formed with two-tier sides to define outwardly-protruding flanges 8 running substantially the entire length of each side. Cover plate 4 comprises a substantially rectangular frame with an aperture entering one end to receive the slide member 6. The aperture of cover plate 4 is bounded by opposing notches 16 running sidelong for slidable cooperation with the protruding flanges 8 of slide member 6. A self-adhesive pad 12 is adhered beneath the cover plate 4, the pad 12 comprising a similarly-shaped layer of adhesive material fixedly bonded on one side beneath the cover plate 4, and having a peel-away protective paper on the other side which is removed to expose a self-adhesive backing for convenient application inside the appliance.

Figure 3:
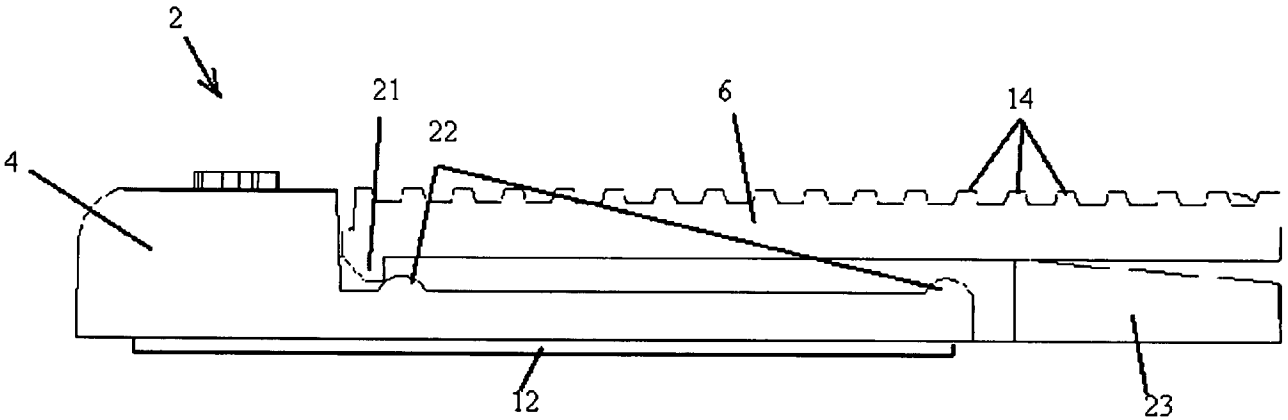
FIG. 3 is a side cross-sectional view of the Sabbath Switch Cover 2 as in FIG. 1 in retracted position for normal light operation.
Figure 4:
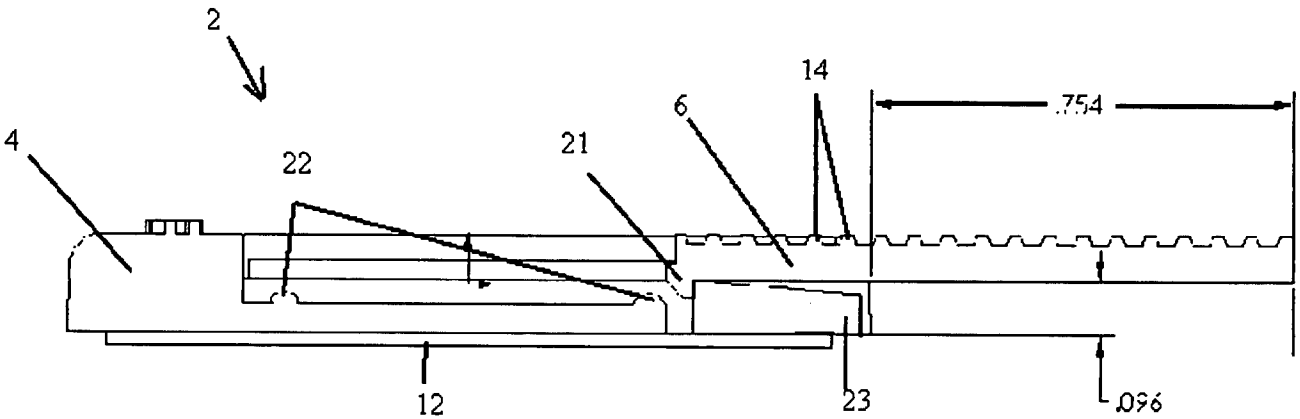
FIG. 4 is a side cross-sectional view of the Sabbath Switch Cover 2 as in FIG. 3 in extended position for Sabbath-mode light operation in which the appliance light operation is disabled.

FIG. 3 is a side cross-sectional view of the Sabbath Switch Cover 2 as in FIG. 1 in retracted position, thereby enabling normal light operation, and FIG. 4 shows the Sabbath Switch Cover 2 in extended position for Sabbath-mode light operation in which the appliance light operation is disabled. In operation, the slide member 6 can be urged in or out of a cover plate 4, from a retracted to an extended position, thereby selectively covering the recessed spring switch 10 of the appliance and keeping it depressed to disable the appliance lighting.

FIG. 4 is a side cross-sectional view of the Sabbath Switch Cover 2 as in FIG. 3 with slide member 6 in an extended position, thereby implementing Sabbath-mode light operation and disabling the appliance lighting. Once extended, the slide member 6 stays in place over the spring switch 10 until it is manually slid back into the cover plate 4, wherein normal light operations resume. To facilitate sliding, the inner end of the slide member 6 is formed with a downwardly-protruding tongue 21, and a plurality of upwardly protruding index bumps 22 (or raised ribs) are formed along the floor of the cover plate 4. One index bump 22 is positioned toward the rear of the cover plate floor to index the fully-retracted position, and another index bump 22 is positioned toward the front of the cover plate floor to index the fully-extended position. Intermediate index bumps 22 may be included as a matter of design choice, and the presently preferred embodiment employs ten (10) equally spaced along the floor of the cover plate 4. As the downwardly-protruding tongue 21 of the slide member 6 encounters the index bumps 22 along the floor of the cover plate 4, a degree of tactile resistance is imparted to the user, thereby indexing the fully-retracted and fully-extended positions, as well as other positions as desired.

In addition to the index bumps 22, a slide brake 23 is formed at the front end of the aperture entering the cover plate 4. The slide brake 23 is formed as a truncated ramp as shown. This allows assembly of the slide member 6 into the cover plate 4, whereupon the downwardly-protruding tongue 21 will ride up and traverse the ramped slide brake 23. However, thereafter the downwardly-protruding tongue 21 cannot be pulled back over the slide brake 23, and this prevents the user from over-extending the slide member 6 and dislodging it from the cover plate 4.

Figures 5, 6, 7, 8, 9:
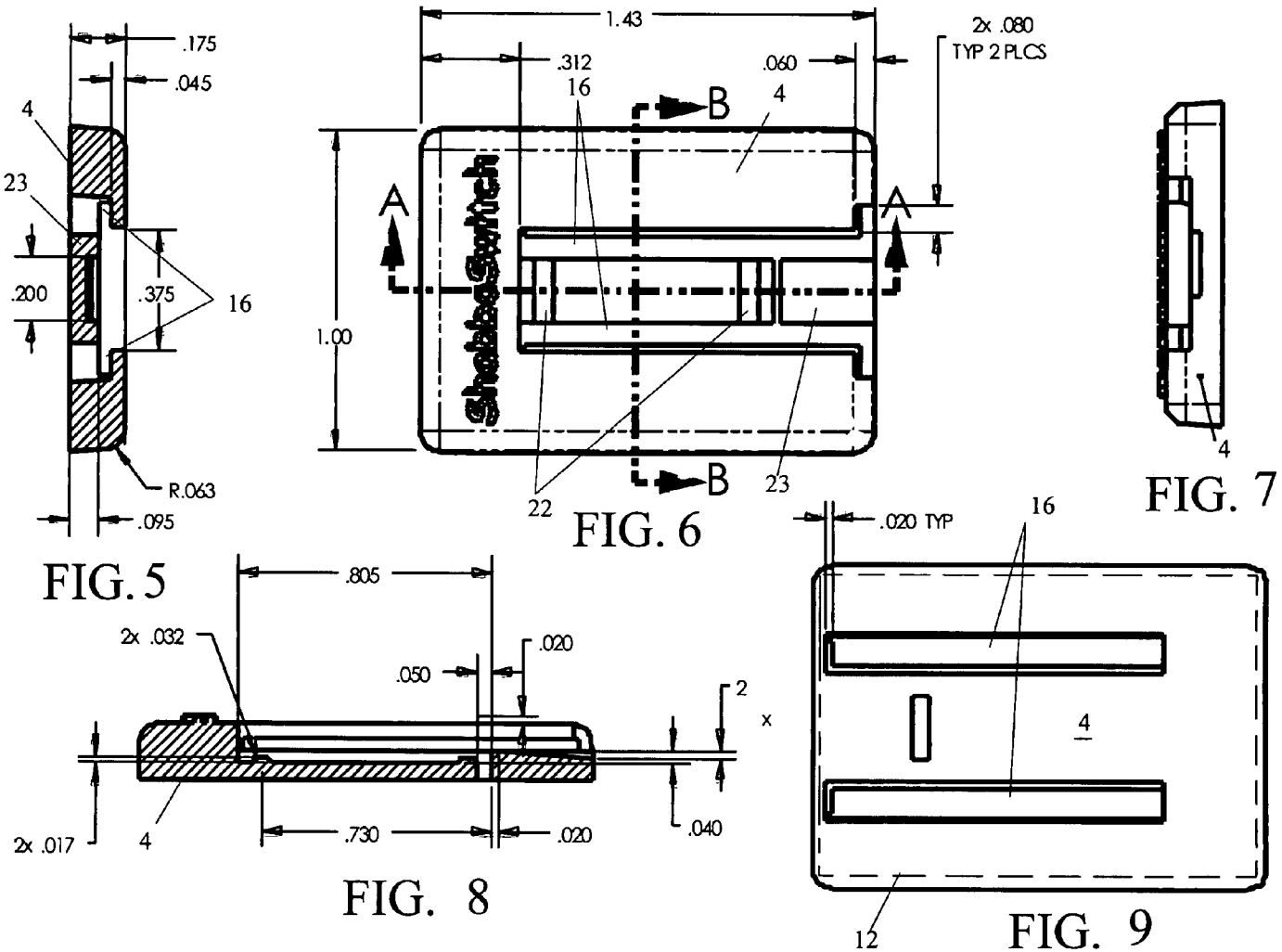
FIG. 5 is an enlarged front end view of the cover plate 4 illustrating the opposing notches 16 running sidelong along the aperture.
FIG. 6 is an enlarged top view of the cover plate 4 as in FIG. 5.
FIG. 7 is an enlarged rear end view of the cover plate 4 as in FIGS. 5–6.
FIG. 8 is a side cross-sectional view of the cover plate 4 as in FIGS. 5–7.
FIG. 9 is a bottom view of the cover plate 4 as in FIGS. 5–8.

FIG. 5 is an enlarged front end view of the cover plate 4, with exemplary dimensions (in inches), illustrating the opposing notches 16 running sidelong along the aperture. The cover plate 4 may be molded or otherwise formed from one-quarter inch heavy PVC plastic in approximately one-inch square dimensions. One skilled in the art will understand that both the cover plate 4 and slide member 6 are provided in several sizes and colors to match most major kitchen appliances. The notches 16 further comprise opposing narrow recessed tracks each with an overhang protruding outward above the aperture in which the slide member 6 resides, thereby cooperating with the protruding flanges 8 of slide member 6 and confining the slide member 6 to slidable movement within the cover plate aperture.

FIG. 6 is an enlarged top view of the cover plate 4, with exemplary dimensions (in inches), as in FIG. 5, which shows the configuration of the aperture in cover plate 4 with opposing notches 16 running sidelong along its length. The position of index bumps 22 (raised ribs) along the floor of the cover plate 4 is also shown.

FIG. 7 is an enlarged rear end view of the cover plate 4 as in FIGS. 5–6, and FIG. 8 is a side cross-sectional view of the cover plate 4 as in FIGS. 5–7. FIG. 9 is a bottom view of the cover plate 4, which illustrates how the opposing notches 16 may be formed by a raised mold, lifting them above the floor of the cover plate 4. The outlines of the self-adhesive pad 12 are shown in dotted lines.

Figure 10:
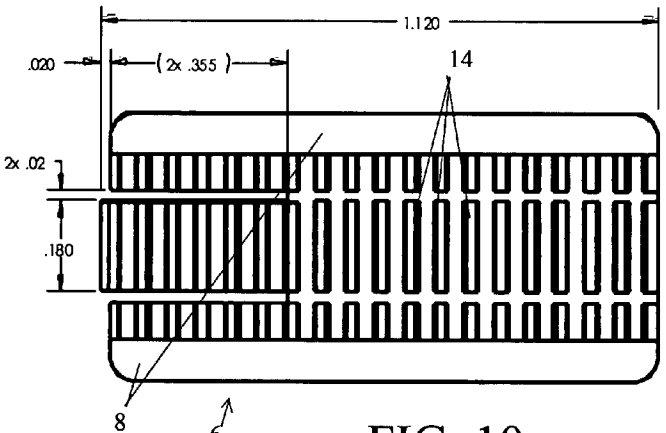
FIG. 10 is an enlarged top view of the slide member 6 used in the Sabbath Switch Cover 2 as in FIGS. 1–4.

FIG. 10 is an enlarged top view of the slide member 6 used in the Sabbath Switch Cover 2 as in FIGS. 1–4, with exemplary dimensions (in inches), illustrating the opposing outwardly-protruding flanges 8 running substantially the entire length of each side. The slide member 6 may likewise be molded or otherwise formed from one-eighth inch heavy PVC plastic in approximately one-half inch square dimensions (to match the aperture). The flanges 8 fit into the notches 16 in the cover plate 4. Preferably, the slide member 6 is formed with raised ribs 14 along its top surface to improve finger-grip.

Figure 11:
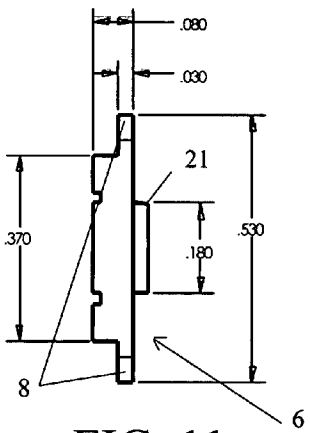
FIG. 11 is an enlarged front end view of the slide member 6 as in FIG. 10.
Figure 12:
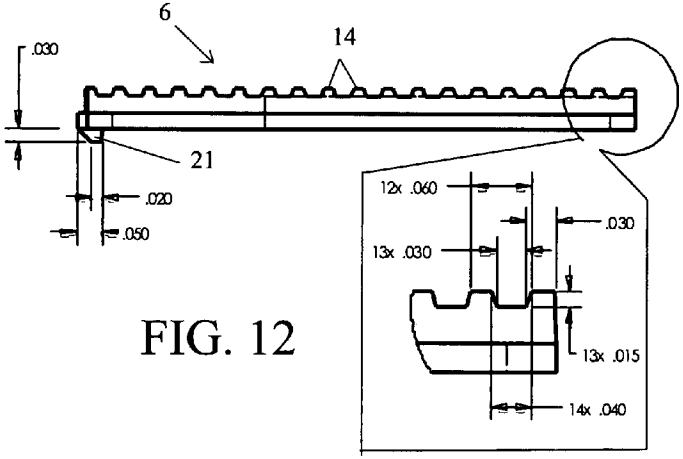
FIG. 12 is a side view of the slide member 6 as in FIGS. 10–11 with enlarged detail drawing of raised ribs 14 along its top surface to improve finger-grip.

FIG. 11 is an enlarged front end view of the slide member 6 as in FIG. 10, with exemplary dimensions (in inches), illustrating the protruding tongue 21 that prevents the user from over-extending the slide member 6 (dislodging it from the cover plate 4). FIG. 12 is a side view of the slide member 6 as in FIGS. 10–11 also showing tongue 21. FIG. 12 also shows an enlarged detail drawing of raised ribs 14 along the top surface of the slide member 6 to improve finger-grip. One skilled in the art will understand that the top surface may be otherwise textured to achieve the same purpose.

Figure 13:
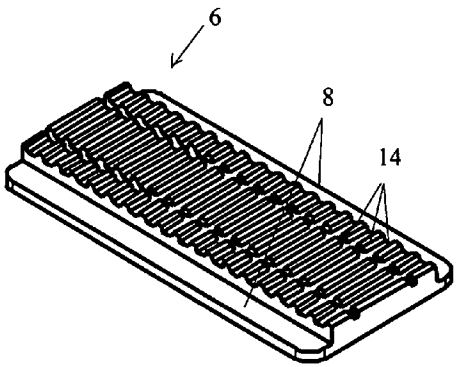
FIG. 13 is a side perspective view of the slide member 6 as in FIGS. 10–12.

FIG. 13 is a side perspective view of the slide member 6 as in FIGS. 10–12.

In operation, with reference back to FIGS. 1 and 2, the Sabbath Switch Cover 2 is installed by peeling off the self-adhesive backing from pad 12 and pressing into place directly adjacent to the appliance's spring switch 10. Under normal weekday operation, the Sabbath Switch Cover 2 remains retracted, allowing the internal light to turn on and off when the door is opened and closed. For Sabbath-mode operation, when the light must be turned off, the Sabbath Switch Cover slide member 6 is moved horizontally until it covers the spring switch 10 in the depressed position. After the Jewish Sabbath or Holidays, the slide member 6 is moved horizontally back into the cover plate 4 to allow the resumption of normal lighting operation.

It is noteworthy that conventional oven light switches vary somewhat from standard refrigerator light switches in that the switch housing can be larger and/or the switch detent can be offset from the switch housing by a greater distance. In this case the switch housing might otherwise interfere with placement of the Sabbath Switch Cover 2, but the cover plate 4 and self-adhesive pad 12 are in this case formed with a cut-out from the bottom to allow the switch cover 4 to mount more closely to the switch without interference from the switch housing.

In addition, each Sabbath Switch Cover 2 may be provided with accessory "spacer plates" with an adhesive pad on one side. A spacer plate can be adhered beneath the Sabbath Switch Cover 2 to provide additional height, thereby ensuring that the cover plate 4 and/or slide member 6 clears switch housings or switch detents that protrude excessively.

Figure 14:
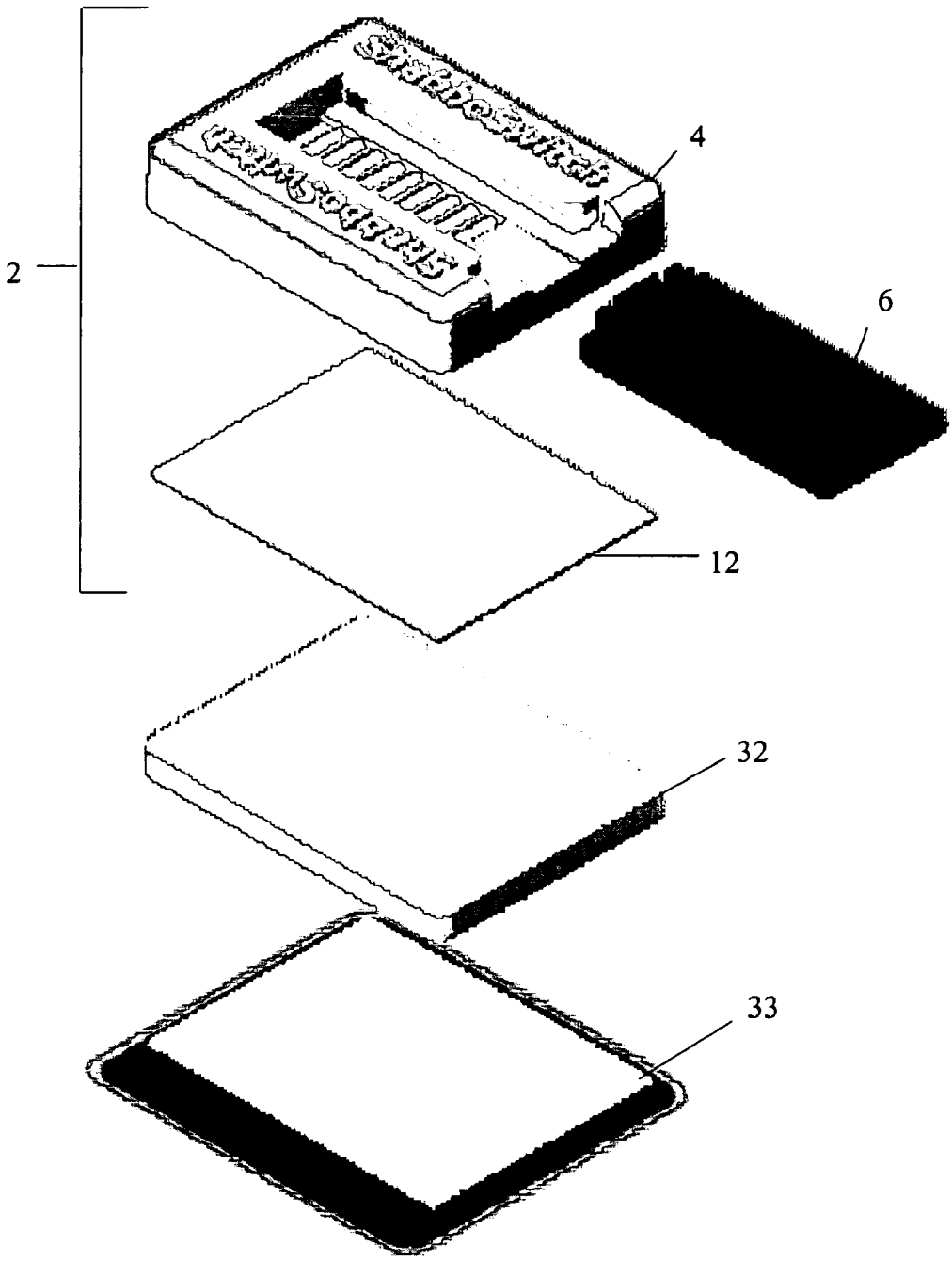
FIG. 14 is a side perspective view of a Sabbath Switch Cover 2 equipped with a spacer plate 32 and self-adhesive pad 33 on the bottom side.

FIG. 14 is a side perspective view of a Sabbath Switch Cover 2 equipped with a spacer plate 32 and self-adhesive pad 33 on the bottom side. The user peels the adhesive pad 33 and attaches beneath the spacer plate 32, then peels the adhesive from the Sabbath Switch Cover 2 and mounts it on top of the spacer plate 32. Further height adjustments can be made if necessary by stacking more than one of the spacer plates 32 before attaching the Sabbath Switch Cover 2.

In all the foregoing cases the Sabbath Switch Cover 2 can be effectively used to selectively disable or enable the internal lighting system of most major kitchen appliances in order to assist in keeping the Jewish Sabbath and Holidays, and it is easily manufactured, inexpensive to produce and purchase, and convenient to apply and use.

Having now fully set forth the preferred embodiments and certain modifications of the concept underlying the present invention, various other embodiments as well as certain variations and modifications thereto may obviously occur to those skilled in the art upon becoming familiar with the underlying concept. It is to be understood, therefore, that the invention may be practiced otherwise than as specifically set forth herein.

I claim:

1. A Sabbath Switch Cover for retrofit installation in a kitchen appliance proximate an internal lighting system detent switch for selectively disabling or enabling an internal lighting system of a kitchen appliance by suppressing operation of its detent switch, comprising:

a cover plate formed as a substantially rectangular frame having a top, a floor, a bottom opposite said floor, and a channel bisecting the top of said rectangular frame and opening to one end thereof, said channel being defined by opposing horizontally-oriented tracks, and a protruding stop inside said channel formed along the floor of said cover plate;

a self-adhesive pad comprising a layer of adhesive material conforming to the bottom of said cover plate and fixedly bonded there beneath for self-adhesive application of said switch cover inside an appliance;

said cover plate being adhered by said self-adhesive pad adjacent to and horizontally offset from an appliance detent switch; and a slide member conforming to the channel of said cover plate and slidably engaged by said horizontal tracks for slidable movement therein and horizontal extension therefrom over top of an appliance detent switch, said slide member having outwardly-protruding flanges for cooperation with the tracks of said channel, and a slide brake at one end for cooperation with the stop formed in the channel of said cover plate to prevent over-extension.

2. The Sabbath Switch Cover according to claim 1, wherein said slide member is formed with a textured upper surface to improve finger grip.

3. The Sabbath Switch Cover according to claim 1, further comprising at least one index bump formed along the channel of said cover, the slide brake of said slide member encountering said at least one index bump when said slide member is moved to provide tactile feedback to a user.

4. The Sabbath Switch Cover according to claim 3, wherein said self-adhesive pad includes a peel-away protective sheet.

5. A Sabbath Switch Cover for retrofit installation in a kitchen appliance proximate an internal lighting system detent switch for selectively disabling or enabling an internal lighting system of a kitchen appliance by suppressing operation of its detent switch in order to facilitate keeping the Jewish Sabbath and Holidays, comprising:

a cover plate formed as a substantially rectangular frame having a top, a floor, and a bottom opposite said floor, and an aperture bisecting the top of said rectangular frame and entering one end, said aperture being bounded by opposing horizontally-oriented tracks;

a slide member conforming to the aperture of said cover plate and slidably engaged by said horizontal tracks for slidable movement therein and horizontal extension therefrom over top of an appliance detent switch, said slide member having outwardly-protruding flanges for cooperation with the tracks of said cover plate, a slide brake formed in one end for cooperation with a stop formed in the channel of said cover plate to prevent over-extension;

a spacer plate with self-adhesive pad for attachment beneath said cover plate for height adjustment; and a self-adhesive pad adhered beneath said spacer plate for self-adhesive application of said switch cover inside an appliance, said self-adhesive pad comprising a layer of adhesive material conforming to said cover plate and fixedly bonded there beneath with a peel-away protective sheet for self-adhesive application of said switch cover inside an appliance, adjacent to and horizontally offset from a spring switch control of the internal lighting system of said kitchen appliance;

wherein said slide member can be urged horizontally in or out of the cover plate to cover an appliance switch and disable said appliance's lighting during the Jewish Sabbath and Holidays, and can be manually slid back into the cover plate to resume normal lighting operations.

6. The Sabbath Switch Cover according to claim 5, wherein said slide member is formed with a textured upper surface to improve finger grip.

7. The Sabbath Switch Cover according to claim 5, further comprising a plurality of spacer plates each having a self-adhesive pad for collective attachment beneath cover plate for height adjustment.

* * * * *